United States Patent [19]

Arthur

[11] Patent Number: 4,493,445

[45] Date of Patent: Jan. 15, 1985

[54] BODYFORMS

[75] Inventor: Eric R. Arthur, King's Lynn, England

[73] Assignee: A. E. Arthur Limited, King's Lynn, England

[21] Appl. No.: 383,831

[22] Filed: Jun. 1, 1982

[51] Int. Cl.[3] ..... A41H 5/00

[52] U.S. Cl. ..... 223/68

[58] Field of Search ..... 223/66, 68, 69

[56] References Cited

U.S. PATENT DOCUMENTS

| | | | |
|---|---|---|---|
| 1,514,086 | 11/1924 | Jankus | 223/68 |
| 3,734,362 | 5/1973 | Arthur | 223/68 |
| 3,838,800 | 10/1974 | Arthur et al. | 223/68 |

FOREIGN PATENT DOCUMENTS

| | | | |
|---|---|---|---|
| 2043158 | 10/1980 | United Kingdom | 223/66 |
| 2064195 | 6/1981 | United Kingdom | 223/68 |

*Primary Examiner*—Louis K. Rimrodt

*Attorney, Agent, or Firm*—Lee, Smith & Zickert

[57] ABSTRACT

A bodyform, in particular a dressform, wherein a central support carries opposed pairs of body sections which are adjustable in spacing by means of adjustment mechanisms mounted on the central support, which mechanism is operable by an operating rod projecting from the bodyform and which is rotatable about its axis to operate the adjustment mechanism and is axially displaceable to lock said mechanism in its adjusted position. A preferred adjustment mechanism comprises a pair of pushrods which drive opposed pairs of body sections equally and oppositely, these pushrods being engaged with opposite sides of a central cog thus enabling a driving gear on the operating rod to act on one of the pushrods only. The adjustment mechanism is accommodated in a housing which carries fixed teeth in spaced overlapping relationship to the teeth of the pushrod whereby opposite axial movement of the rod engage and disengage the gear from the fixed teeth while such gear remains in engagement with the pushrod.

10 Claims, 10 Drawing Figures

BODYFORMS

This invention relates to a bodyform, such as a dressform or tailor's dummy, and has for its object to provide an improved arrangement of bodyform incorporating a simple and inexpensive adjusting means which is easy to operate.

According to the invention, there is provided a bodyform comprising an upstanding central support, a plurality of pairs of opposed body sections around the central support, a plurality of locking adjustment mechanisms for the pairs of body sections, carried on the central support and adjustably supporting the pairs of body sections, and an operating rod for each adjustment mechanism which projects laterally from the composite body formed by the body sections, the adjustment mechanism being arranged and coupled to the operating rod in such a manner that axial displacement of the operating rod in opposite directions respectively locks and unlocks the adjustment mechanism, while a rotational movement of the operating rod about its axis, in the unlocking condition of said rod, causes the adjustment mechanism to move the body sections of at least one opposed pair equally and oppositely relative to the central support, thereby to adjust the dimensions of the relevant part of the composite body.

In a practical arrangement, each adjustment mechanism comprises a pair of spaced, parallel, toothed pushrods, one for each body section of a pair thereof, a coupling gear mounted on the central support to engage between the pair of toothed pushrods, and a driving gear carried by the operating rod. The driving gear preferably drivingly engages one of the push rods, but could alternatively engage the coupling gear. Conveniently, the driving gear, when the operating rod is in its locking condition, also engages locking means on a part fixedly carried by the central support. Thus, in the unlocking condition of the operating rod, the driving gear engages the pushrod only, but in the axially displaced locking condition of said rod, the driving gear engages the locking means, thus locking the adjustment mechanism in a chosen adjusted condition of the corresponding pair of body sections. The said fixed part is preferably part of a mounting assembly which carries the adjustment mechanism and serves as a guide for the pushrods.

Conveniently, each operating rod may project laterally from the composite body at one end only, and carry an abutment at its other end which engages the central support to limit axial movement of the operating rod in the unlocking direction.

The body sections may be made of foamed plastics material which are mounted to the push rods through the intermediary of a foamed plastics mounting block. Such foamed plastics material is inexpensive, but liable to crack or break if put under strain. The above-described practical arrangement of the adjustment mechanism enables the bodyform to be adjusted without placing strain on the individual body sections. In an alternative advantageous arrangement the body sections are made of foamed plastics material and are detachably mounted to the pushrods by interengaging fittings. For example, said fittings may comprise slotted webs integrally moulded with the body sections and lateral flanges carried by the pushrods. In a preferred embodiment, in at least one of the adjustment mechanisms, said lateral flanges project to both sides of the pushrods, respectively to engage in the body sections of two adjacent opposed pairs thereof.

The bodyform of the invention has various applications, not only in garment making but in various fields of research and analysis. However, one particular application of the invention is to a dressform having three pairs of body sections respectively adjustable for differing bust, waist and hip sizes.

A practical arrangement of bodyform in accordance with the invention will now be described by way of example with reference to the accompanying drawings, in which.

Figure 1:
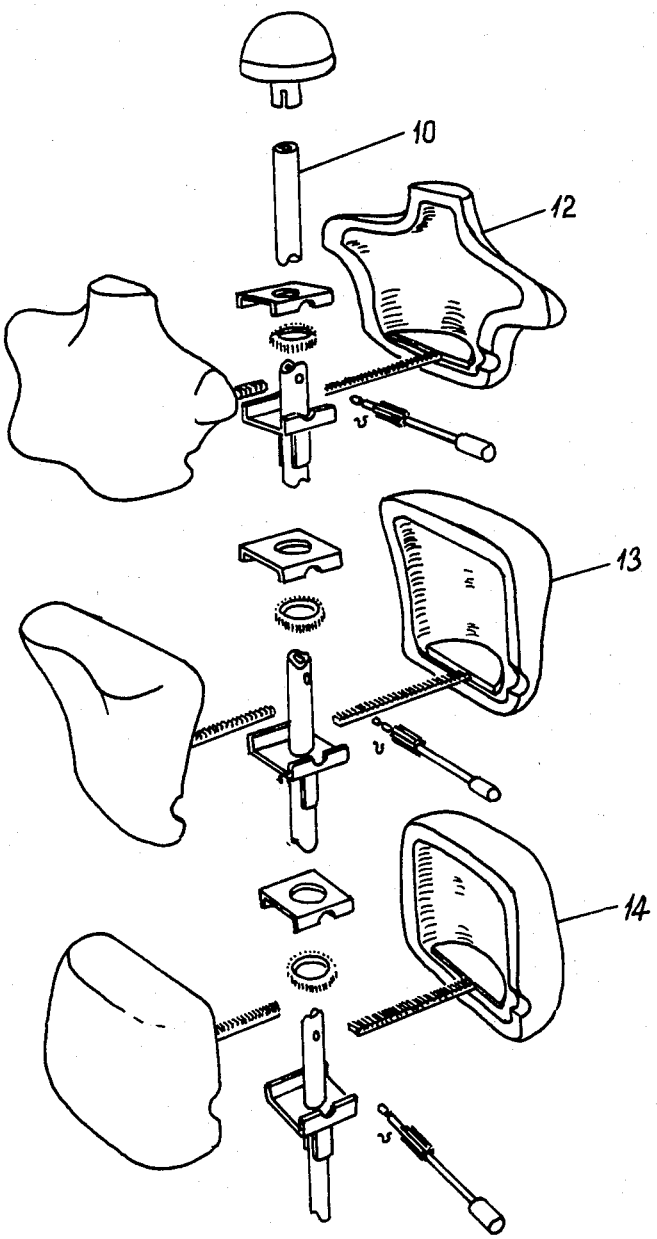
FIG. 1 is a diagrammatic exploded view of the bodyform.

The arrangement shown in FIG. 1 consists of a dressform which has a central tubular support 10 upstanding from a tripod rest (not shown). The central support 10 carries three pairs of opposed body sections 12, 13 and 14, the respective pairs being relatively adjustable for differing bust, waist and hip sizes. In the finished dressform, the composite body formed by the body sections has a cloth cover, which is omitted in the drawing.

Figure 2:
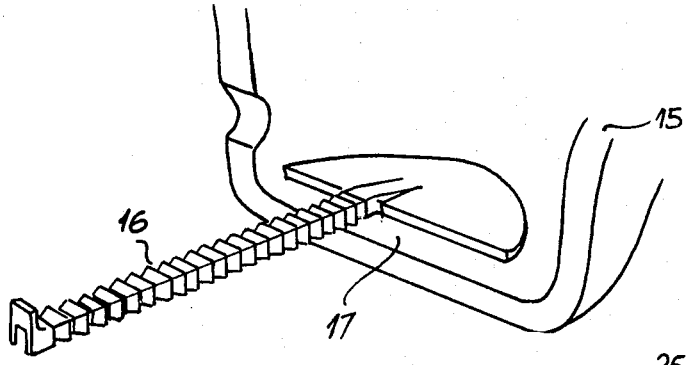
FIG. 2 shows a pushrod carrying a section of the bodyform.
Figure 3:
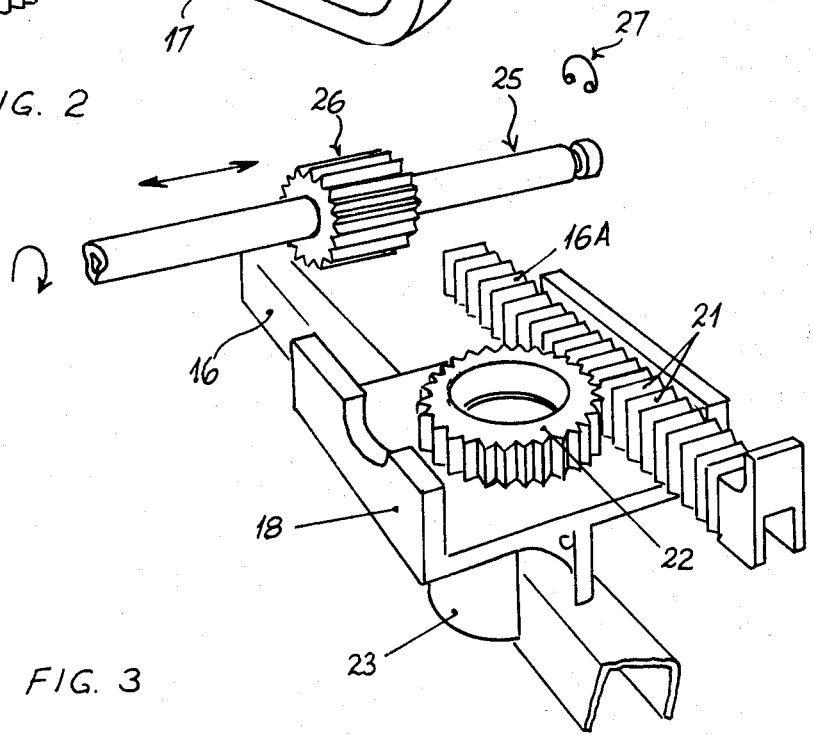
FIG. 3 is a diagrammatic view showing the parts of a locking adjustment mechanism incorporating a pair of pushrods.
Figure 4:
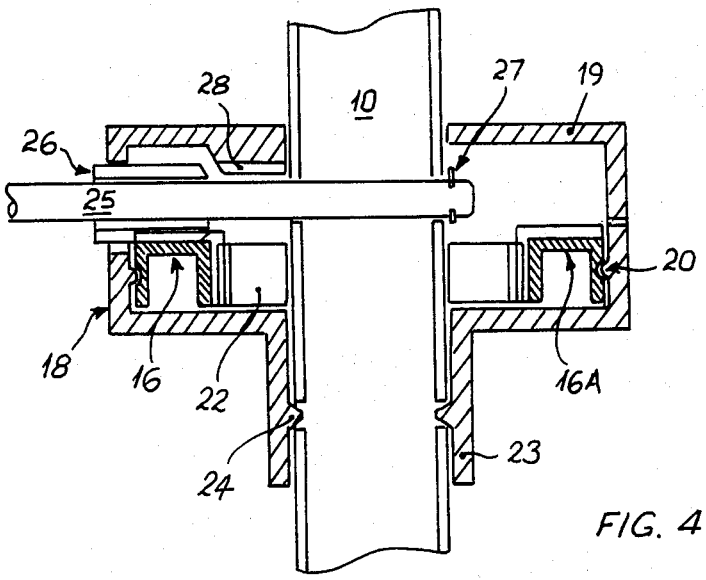
FIG. 4 is a transverse sectional view through an adjustment mechanism mounted on a central support for the bodyform.

As can be clearly seen from FIG. 1, the respective pairs of body sections are similarly supported for adjustment purposes, and it will therefore suffice to describe the supporting and adjusting means for one pair of body sections only, for which purpose reference is also made to FIGS. 2, 3 and 4.

As shown in FIG. 2, each body section 15 is mounted on one end of a channel-section pushrod 16 through the intermediary of a mounting block 17. The body section 15 is in the form of a half-shell, conveniently made of foamed plastics material. The end of the pushrod 16 is embedded in the mounting block 17, conveniently also made of foamed plastics material, the mounting block being fixed to the interior of the half shell 15.

A pair of pushrods 16, 16A are incorporated in an adjustment mechanism shown in FIGS. 3 and 4. In FIG. 3, the pushrod 16 is shown in transparent outline, in order not to obscure other parts of the mechanism. This mechanism comprises a casing having lower and upper parts 18, 19 (the upper part 19 being omitted in FIG. 3), the lower part having internal ribs 20 on its side walls to guide longitudinal movement of the pushrods 16, 16A. In the orientation in which the push rods 16, 16A are assembled in the casing 18, 19, the ribs 20 cooperate with longitudinal grooves in the outer side wall of the pushrods, while the upper and inner side walls of the pushrods 16, 16A are formed with teeth 21. Between the pushrods 16, 16A the casing accommodates a coupling gear 22 which on opposite sides meshes with the side teeth 21 of the pushrods.

As will be clear from FIGS. 1 and 4, the casing 18, 19 and the coupling gear 22 are mounted at the appropriate level on the central support 10. For this purpose, the lower part 18 of the casing carries a sleeve or hollow boss 23 surrounding the support 10 and having an internal detent 24 which engages a notch in the central support, and the coupling gear 22 is rotatable within the casing 18, 19 around said central support.

Cooperating with the adjustment mechanism is an operating rod 25, which fixedly carries a driving gear 26. The rod 25 projects through one side wall of the casing 18, 19 so that the driving gear 26 meshes with the upper teeth 21 of the adjacent pushrod 16. Thus, when the operating rod is rotated about its axis, the one pushrod 16 is longitudinally driven directly, while the other pushrod 16A is longitudinally driven equally in the opposite direction through the coupling gear 22. This means that a pair of the body sections 12, 13 or 14 are moved apart or towards one another, depending on the sense in which the operating rod 25 is rotated, thereby to adjust the bust, waist or hip size of the bodyform.

At one end region remote from the adjustment mechanism, the operating rod 25 projects laterally from the bodyform (see FIG. 1), while at its other end region within the casing 18, 19, the operating rod extends through the central support 10 and on the remote side thereof is grooved to receive a circlip 27. This circlip 27 limits axial movement of the rod 25 outwardly of the bodyform, to prevent disengagement of the driving gear 26 from the pushrod 16. However, the operating rod 25 is axially displaceable inwardly of the bodyform to lock the adjustment mechanism in a chosen position of adjustment. In order to achieve such locking, the upper part 19 of the casing is formed with teeth 28. When the operating rod 25 is axially displaced inwardly, to an extent limited by engagement of the driving gear 26 with the central support 10, said driving gear 26 engages with the fixed teeth 28 on the casing, and is long enough in the longitudinal direction of the operating rod 25 to remain in engagement with the upper teeth 21 of the pushrod 16 at the same time, thus locking the mechanism against further adjustment until the rod 25 is again withdrawn outwardly.

The manner and sequence of assembly of the various parts of the dressform on the central support will be clear from FIG. 1 without detailed description.

In use, the dressmaker adjusts the bodyform by use of each of three operating rods, one for each pair of body sections 12, 13 and 14, in turn. Each part of the bodyform is adjusted by retracting the operating rod outwardly, rotating it until the desired bust, waist or hip size has been obtained (this being determined by tape measure for example, although measuring dials can readily be incorporated in the bodyform and linked to the adjustment mechanisms if desired), and then pushing in the rod 25 to lock the relevant part of the bodyform in the appropriately adjusted position. The whole operation can be carried out simply and quickly.

Furthermore, while the adjusting means is in itself simple and inexpensive, it at the same time permits the use of the inexpensive foamed plastics body sections referred to above. Such material would be liable to crack or break if subjected to strain during adjustment. However, without introducing any backlash sufficient to cause dimensional errors in the adjusted bodyform, the above described adjusting means avoids the use of springs or links between pairs of opposed body sections which would be liable to create strain or place stress on the structure of the body sections.

Figure 5A:
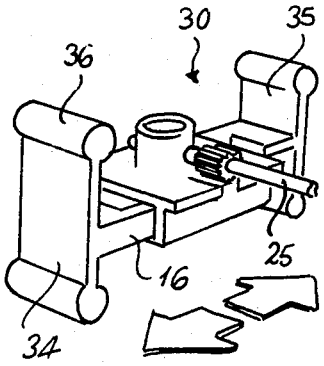
FIG. 5A is view of the internal adjustment mechanism in detail.
Figure 5:
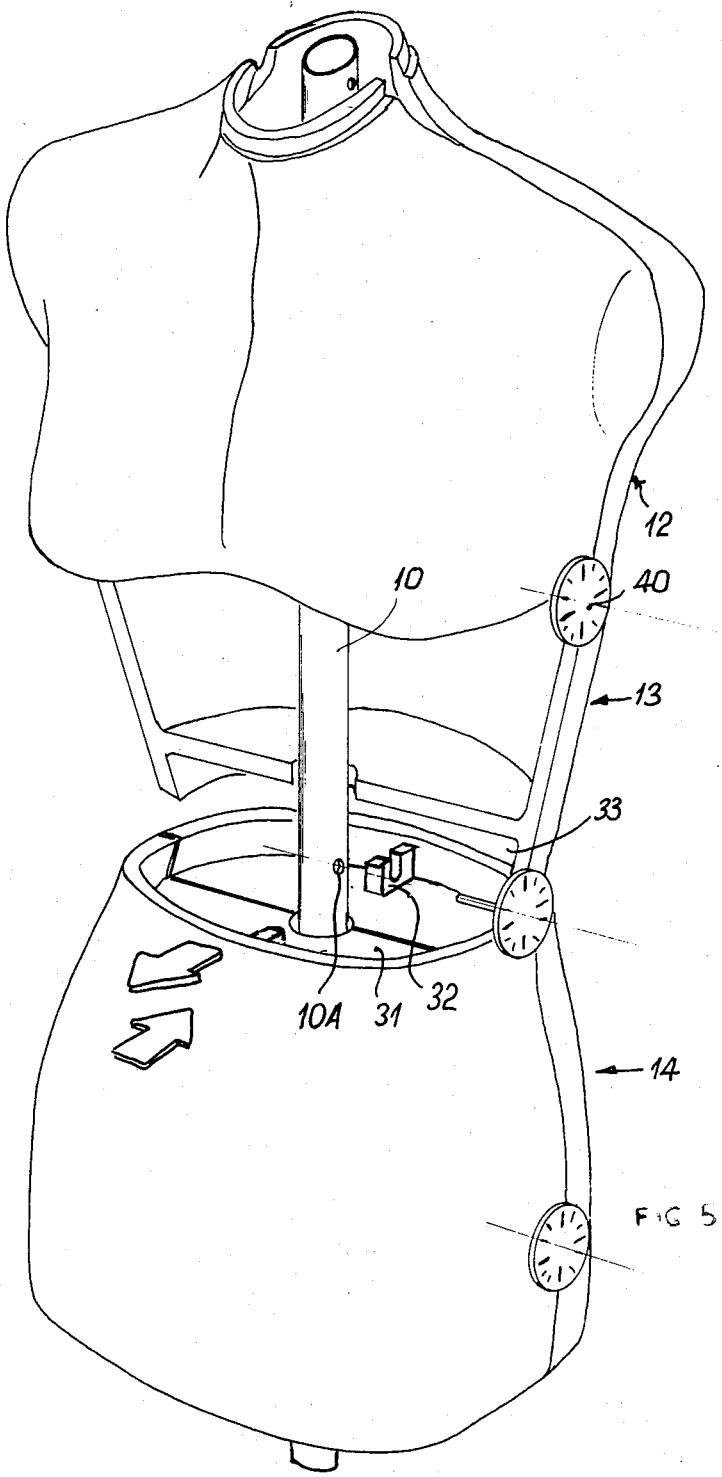
FIG. 5 shows a bodyform according to a modified embodiment, with the waist section removed and the internal adjustment mechanism for said section separated out more clearly to show the details thereof.
Figure 6:
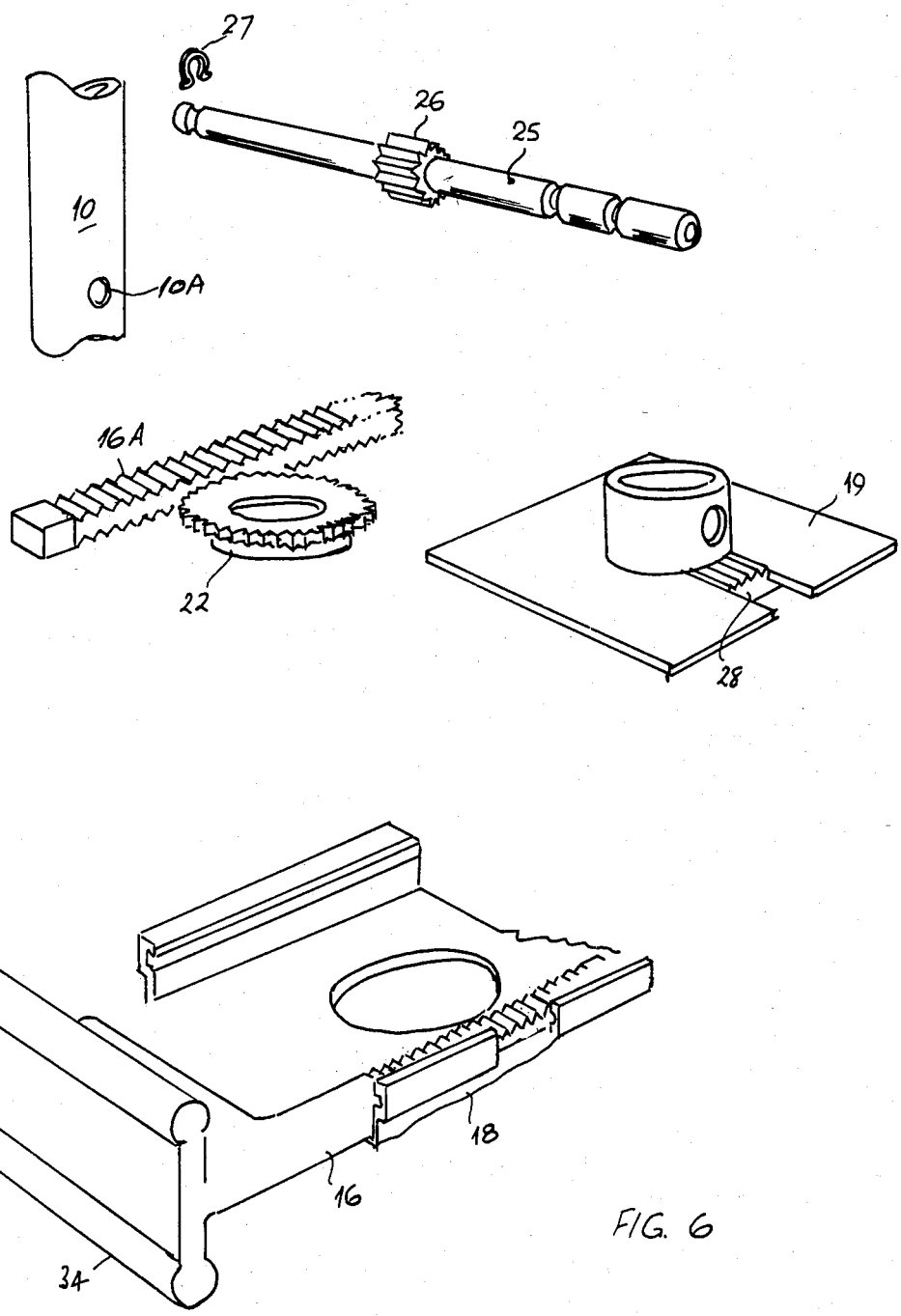
FIG. 6 is a diagrammatic exploded view of the adjustment mechanism.

In the modified embodiment shown in FIGS. 5, 5A and 6, similar reference numerals are used for similar parts.

FIG. 5 shows a bodyform with the front central body section 13 removed. The internal adjustment mechanism 30 for the intermediate sections 13 is shown separated. This intermediate mechanism 30 is substantially as previously described with reference to the embodiment of FIGS. 1 to 4. However, different means of detachable nature is employed to connect the pushrods to the body sections.

Thus, as shown at the top of the opposed body sections 14, the upper surfaces of these sections 14 are recessed at 31 to accommodate slotted upstanding webs 32. The lower surfaces of the body sections 13 are similarly recessed at 33 to accommodate similar slotted depending webs (not visible in the drawing). These slotted webs are integrally moulded with the body sections of expanded foam plastics material. The slotted webs 32 on the body sections 13 and 14 are respectively engaged by lateral flanges 34, 35 respectively carried by and projecting to both sides of the pushrods 16, 16A of the adjustment mechanism 30. The slots in the webs 32 are undercut to receive the enlarged nosings 36 on the flanges 34 and 35.

A functional difference from the embodiment of FIGS. 1 to 4 thereby arises, in that operation of the adjustment mechanism 30 by its operating rod 25 adjusts both the pair of body sections 13 and the pair of body sections 14, causing them to tilt relative to their connections to the upper and lower adjustment mechanisms. The upper internal adjustment mechanism acts in analogous manner between the opposed pairs of body sections 12 and 13, whilst the lower internal adjustment mechanism acts solely on the lower pairs of body sections 14. A spring linkage or limiting ring (not shown) may be provided at the neck opening defined between the tops of the opposed body sections 12.

Details of the intermediate internal adjustment mechanism 30 (the upper and lower mechanisms are similar) are also shown in FIGS. 5 and 6, and by use of similar reference numerals to FIGS. 3 and 4 its operation will be clear without detailed description. The operating rod 25 is provided with a control disc 40 marked as at 41 to show the adjusted bodyform size as the operating rod 25 is rotated.

Assembly of the adjustable bodyform is effected by lowering the adjustment mechanisms, in assembled condition except for the operating rod 25 and the gear 26 carried thereby, over the central supporting tube 10. In turn, the lower, intermediate and upper mechanisms are aligned with the apertures (see 10A) provided in the central support 10, enabling the operating rods 25 to be pushed into position and secured by the circlip 27. The body sections 12, 13 and 14 may be assembled with the adjustment mechanisms before or after assembly of said mechanisms to the central support. The bodyform is completed by application of a two-way stretch cloth sock (not shown), which carries a mark for cooperating with the indicating marks on the control discs.

Operation of the embodiment of FIGS. 5 and 6 is also similar to that of the embodiment of FIGS. 1 to 4. Axial movement of the operating rod 25 (through about 1.25 cm) engages and disengages the gear 26 from locking teeth 28 provided in the upper part 19 of the adjustment mechanism housing. When the gear is disengaged from said locking teeth 28, the rod 25 can be rotated to adjust the size of the bodyform to the appropriate bust, waist and hip sizes as indicated by the markings 41 on the respective control discs 40.

Figure 7:
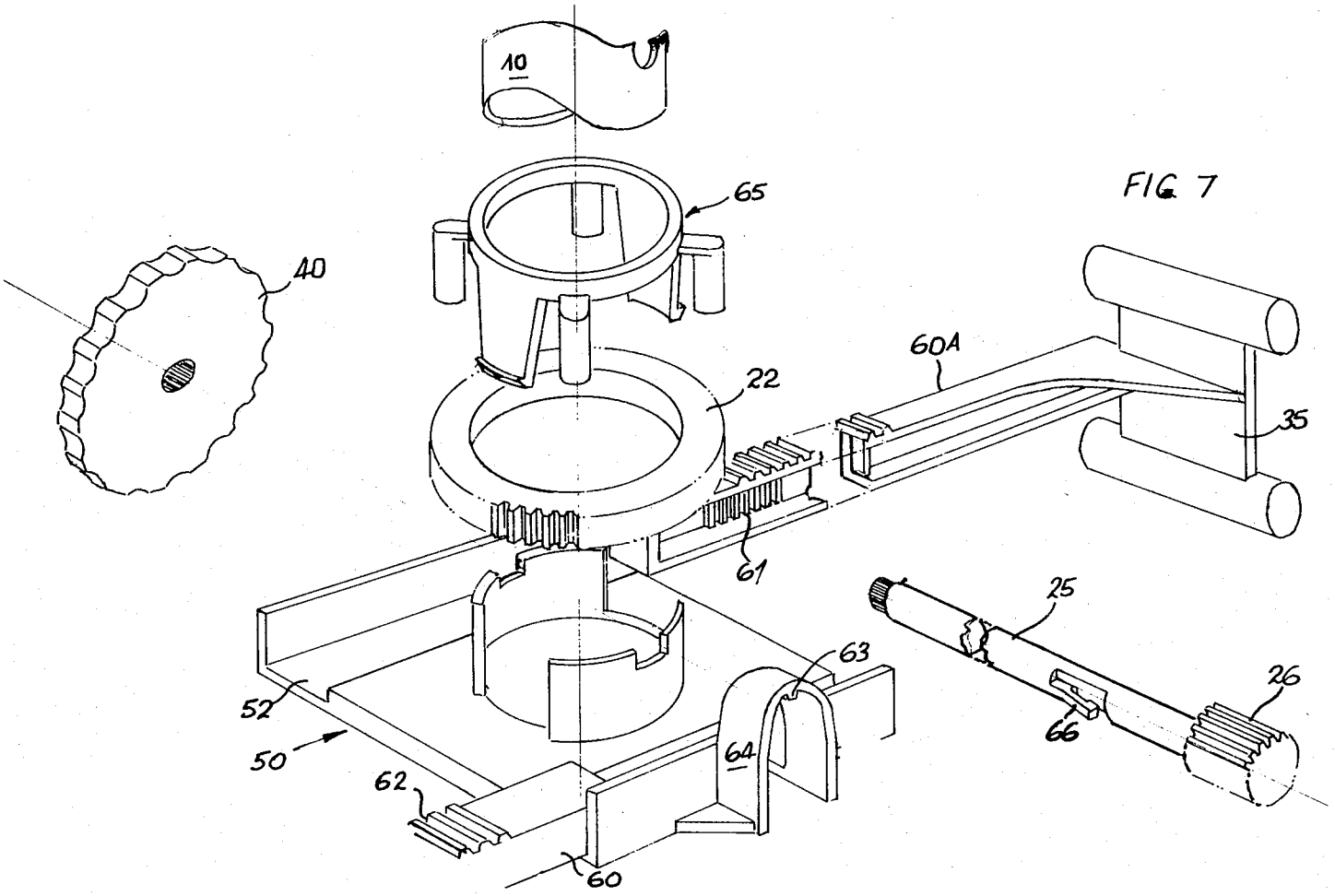
FIG. 7 is an exploded view of a modified adjustment mechanism.
Figure 8:
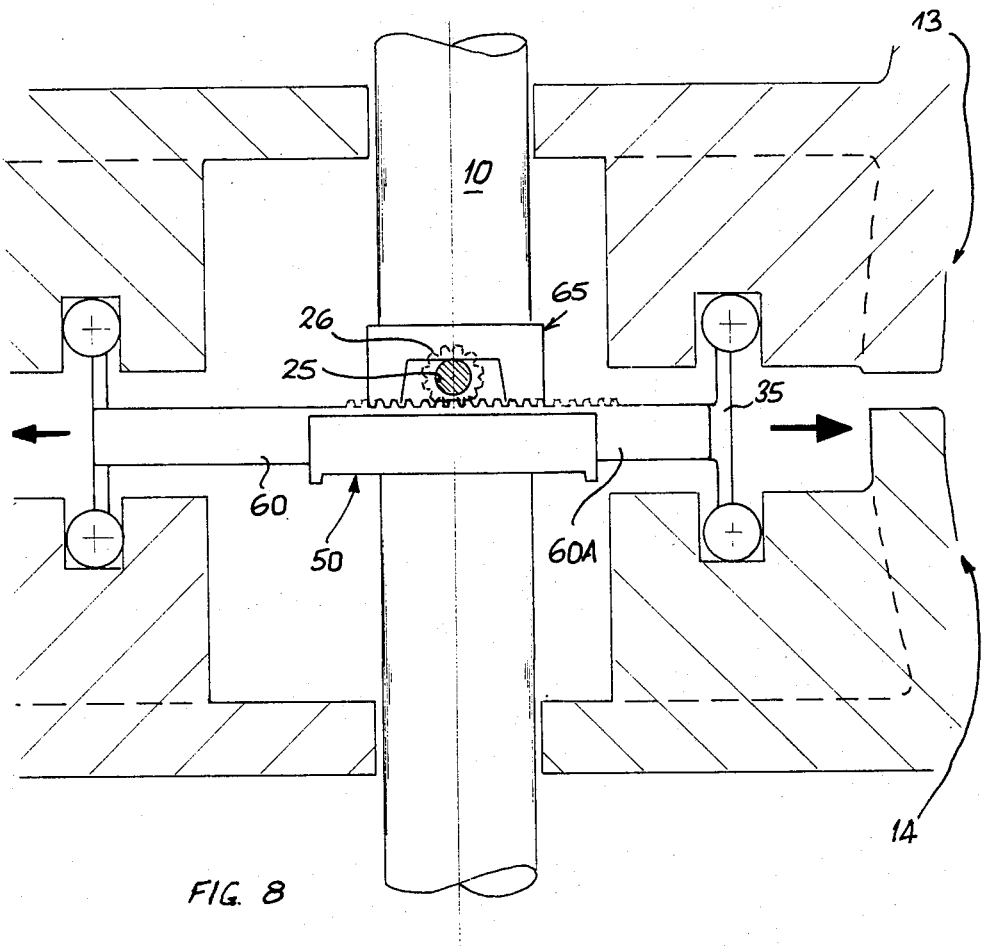
FIGS. 8 and 9 are respective transverse sectional views, mutually at right angles, through the modified adjustment mechanism.
Figure 9:
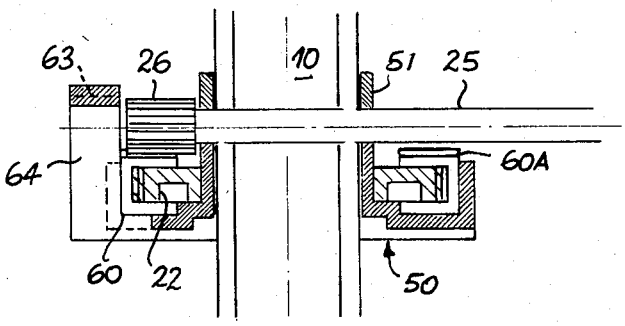

The modified adjustment mechanism of FIGS. 7 to 9 is functionally similar to that of FIGS. 5 and 6, but differs in respect of the structural form of some of the parts. Similar reference numerals to those of FIGS. 5 and 6 are employed in FIGS. 7 to 9 except for certain parts specifically referred to below.

The adjustment mechanism casing 18, 19 of FIGS. 5 and 6 is replaced by a mounting assembly which includes a platform 50 keyable to the central support 10. The platform 50 carries an upstanding hollow bearing 51 for the coupling gear 22, and is formed with guides 52 for pushrods 60, 60A which, along the operative parts of their lengths cooperating with the coupling gear 22 and operating rod driving gear 26, have a channel-shaped cross section facing said coupling gear. The pushrods 60, 60A have teeth 61 for cooperation with the coupling gear 22 formed on the interior base walls of the channels, whereby the coupling gear is located between the opposed channels, and at least the pushrod 60 has teeth 62 formed on the exterior surface of its upper web for cooperation with the driving gear 26. In practice, for convenience of manufacture, the two pushrods 60, 60A are identical.

The locking teeth 28 of the embodiment of FIGS. 5 and 6 are replaced by a single locking tooth 63 formed inside an arch 64 mounted to the side of the platform 50 and through which the operating rod 25 extends. This operating rod 25 then extends through recesses in the bearing 51, and is held down by means of a flanged retaining ring 65 which clips over the bearing. A final difference to be noted is that the circlip 27 (see FIG. 6) which acts as a stop limiting longitudinal movement of the operating rod 25 is replaced by a resilient spigot 66 on the side of the rod, which spigot is pressed into a recess in the rod during assembly and is then released to limit longitudinal movement of the rod by its abutment against the inside of the hollow bearing 51.

It is to be appreciated that the invention has application in fields other than dressforms, and for some applications may include more or less pairs of opposed body sections than three. Furthermore, the adjustment mechanism employed may be modified in various ways, provided that it enables a pair of opposed body sections to be adjusted by means of an axially displaceable and rotatable operating rod in the manner already described.

I claim:

1. A bodyform comprising an upstanding central support, a plurality of pairs of opposed foamed plastics body sections around the central support, each body section having a recess, a locking adjustment mechanism for each pair of body sections, the mechanism being carried on the central support and adjustably supporting pairs of body sections, and an operating rod for each adjustment mechanism which projects laterally from the composite body formed by the body sections, the adjustment mechanism being arranged and coupled to the operating rod in such a manner that axial displacement of the operating rod in opposite directions respectively locks and unlocks the adjustment mechanism, while a rotational movement of the operating rod about its axis, in the unlocking condition of said rod, causes the adjustment mechanism to move the body sections of at least one opposed pair equally and oppositely relative the central support, thereby to adjust the dimensions of the relevant part of the composite body, each adjustment mechanism being connected in respective body sections by flanges which locate in the recesses and allow the body sections to be drawn toward and away from the central support.

2. A body form as set forth in claim 1, wherein each flange ends in an elongate, at least partly cylindrical portion with the cylinder axis at right angles to the direction of movement towards and away from the central support and each flange end is a loose fit in its respective recess, so that the body sections can tilt relative to the flanges.

3. A bodyform as set forth in claim 1 wherein each adjustment mechanism comprises a pair of spaced, parallel, toothed pushrods, one for each body section, a coupling gear mounted on the central support to engage between the pair of toothed pushrods, and a driving ger carried by the operating rod.

4. A bodyform as set forth in claim 3 wherein the driving gear drivingly engages one of the pushrods.

5. A bodyform as set forth in claim 4, wherein the driving gear, when the operating rod is in its locked condition, engages locking means on a part fixedly carried by the central support.

6. A bodyform as set forth in claim 5, wherein said part is part of a mounting assembly which carries the adjustment mechanism and serves as a guide for the pushrods.

7. A bodyform according to claim 1, wherein each adjustment mechanism comprises a pair of spaced, parallel, toothed pushrods, and in at least one of the adjustment mechanisms, said lateral flanges project to both sides of the pushrods, respectively to engage in the body sections of two adjacent opposed pairs thereof.

8. A bodyform according to claim 1 wherein each operating rod projects laterally from the composite body at one end only, and carries an abutment at its other end which engages the central support to limit axial movement of the operating rod in the locking direction.

9. A bodyform as set forth in claim 8 wherein the projecting end of each operating rod carries a control disc marked to provide an indication of the adjusted bodyform size during rotation of the operating rod.

10. A bodyform according to claim 1 comprising a dressform having three pairs of body sections respectively adjustable for differing bust, waist and hip sizes.

* * * * *